US008973195B2

(12) United States Patent
Breault

(10) Patent No.: US 8,973,195 B2
(45) Date of Patent: Mar. 10, 2015

(54) PIPELINE CROSSING BRIDGE

(71) Applicant: Marc Breault, Sturgeon County (CA)

(72) Inventor: Marc Breault, Sturgeon County (CA)

( * ) Notice: Subject to any disclaimer, the term of this patent is extended or adjusted under 35 U.S.C. 154(b) by 0 days.

(21) Appl. No.: 14/054,736

(22) Filed: Oct. 15, 2013

(65) Prior Publication Data

US 2014/0041135 A1 Feb. 13, 2014

Related U.S. Application Data

(63) Continuation of application No. 13/223,235, filed on Aug. 31, 2011, now abandoned.

(51) Int. Cl.

| | |
|---|---|
| ***E01D 15/12*** | (2006.01) |
| ***E01D 4/00*** | (2006.01) |
| ***E02D 17/10*** | (2006.01) |
| ***E01D 15/133*** | (2006.01) |
| ***E01C 9/08*** | (2006.01) |

(52) U.S. Cl.

CPC *E01D 15/12* (2013.01); *E01D 4/00* (2013.01); *E02D 17/10* (2013.01); *E01D 15/133* (2013.01); *E01C 9/083* (2013.01)

USPC ..... 14/2.4; 14/24

(58) Field of Classification Search

USPC ..... 14/2.4, 24; 404/35, 45

See application file for complete search history.

(56) References Cited

U.S. PATENT DOCUMENTS

| | | | | |
|---|---|---|---|---|
| 227,834 | A | 5/1880 | Quinby | |
| 2,208,080 | A | 7/1940 | Overdorff | |
| 2,690,821 | A | 10/1954 | Holley | |
| 3,638,434 | A | 2/1972 | Delaere | |
| 3,768,108 | A | 10/1973 | Wadsworth | |
| 4,118,816 | A * | 10/1978 | Mittag | 14/69.5 |
| 4,141,666 | A | 2/1979 | DeGraff | |
| 4,695,187 | A | 9/1987 | Mikhailovsky | |
| 4,965,903 | A | 10/1990 | Bisch | |
| 5,042,101 | A | 8/1991 | Huether | |

(Continued)

FOREIGN PATENT DOCUMENTS

CA 2 366 241 * 6/2003

OTHER PUBLICATIONS

EnviroBridge: Quick Crossing Concepts™, "The Concept," © 2011 EnviroBridge, Sanders & Company Contracting, Ltd., Merritt, Canada, <http://www.enviro-bridge.ca> (home page) [retrieved Aug. 2, 2011], 1 page.

(Continued)

*Primary Examiner* — Gary Hartmann

(74) *Attorney, Agent, or Firm* — Christensen O'Connor Johnson Kindness PLLC

(57) ABSTRACT

A combination of a buried pipeline and a pipeline crossing bridge, the pipeline crossing bridge comprising: a first ground contacting pad and a second ground contacting pad spaced apart from one another; plural ribs with lateral stabilizing elements between adjacent ribs of the plural ribs, in which each rib of the plural ribs is supported on the first ground contacting pad and the second ground contacting pad and the ribs collectively form a raised arch extending between the first ground contacting pad and the second ground contacting pad; an upper crossing surface supported by the plural ribs, in which the pipeline crossing bridge is positioned over the buried pipeline, and in which the buried pipeline has a diameter, and the first ground contacting pad and the second ground contacting pad are spaced apart wider than the diameter of the buried pipeline.

1 Claim, 3 Drawing Sheets

(56) References Cited

U.S. PATENT DOCUMENTS

| | | | | |
|---|---|---|---|---|
| 5,118,218 | A | 6/1992 | Musser | |
| 5,590,433 | A | 1/1997 | Fricke | |
| 5,603,134 | A | 2/1997 | Whipkey | |
| D406,364 | S | 3/1999 | Robert | |
| 6,611,982 | B2 | 9/2003 | Eberl | |
| 6,722,814 | B2 | 4/2004 | Byrne | |
| 6,799,345 | B2 | 10/2004 | Occhiolini | |
| D511,215 | S | 11/2005 | Vaia | |
| 7,240,387 | B1 | 7/2007 | Berggren | |
| 7,546,654 | B2 | 6/2009 | Carmel | |
| 7,604,431 | B2 | 10/2009 | Fournier | |
| 7,861,346 | B2 | 1/2011 | Wilson | |
| 2010/0031454 | A1 | 2/2010 | Deschamps | |
| 2011/0142539 | A1 | 6/2011 | Sekine | |
| 2013/0047351 | A1* | 2/2013 | Breault | 14/24 |

OTHER PUBLICATIONS

EnviroBridge: Quick Crossing Concepts™, "Enviro-Bridge—Bottomless Culverts," © 2011 EnviroBridge, Sanders & Company Contracting, Ltd., Merritt, Canada, <http://www.enviro-bridge.ca/Bottomless/Culvert.html> [retrieved Aug. 2, 2011], 1 page.

Enviro-Span, "Enviro-Span Modular Culvert Systems," Gallatin, Tenn., <http://www.enviro-span.com/pages/culverts/html>: Download 2150 MM (7 FT) Brochure [retrieved Aug. 2, 2011], 2-pages.

I3oris, "Photo of Gas Pipeline Bridge, Dvorniky, Slovakia," Mar. 22, 2009, Panoramio—Photos of the World, <http://www.panoramio.com/photo/20302197> [retrieved Aug. 2, 2011), 1 page.

Johnson, H. (ed.), "Tech Update: Water Management Products," Logging and Sawmilling Journal, May 2002, 7 pages.

Submar West Africa Ltd., "Flexible Articulated Concrete Mattress Solutions for West Africa: Construction Mattress—9" (22.85cm), <http://www.submarwestafrica.com/constructionMats.cfm> [retrieved May 18, 2011], 3 pages.

Subsea Protection Systems Limited, "Crossing Bridges," © 2009 Subsea Protection Systems, <http://www.hellotrade.com/subsea-protection-systems/crossing-bridges.html> [retrieved May 18, 2011], 1 page.

Trelleborg Offshore, "Polymat™," Sep. 4, 2007, <http://www.trelleborg.com/en/offshore/Products-and-Solutions/Cable—Flowline Protection . . . > [retrieved May 18, 2011], 1 page.

* cited by examiner

PIPELINE CROSSING BRIDGE

CROSS-REFERENCE TO RELATED APPLICATION

This application is a continuation of and claims the benefit under 35 U.S.C. §120 of U.S. application Ser. No. 13/223,235, filed Aug. 31, 2011, which is incorporated by reference herein in its entirety.

TECHNICAL FIELD

This document relates to pipeline crossing bridges.

BACKGROUND

Bridges or roads are used to cross pipelines.

SUMMARY

A pipeline crossing bridge comprising first and second ground contacting pads spaced apart from one another; plural ribs with lateral stabilizing elements between adjacent ribs of the plural ribs, each rib of the plural ribs being supported on both the first and second ground contacting pads and the ribs collectively forming an arch extending between the first and second ground contacting pads; and an upper crossing surface supported by the plural ribs.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
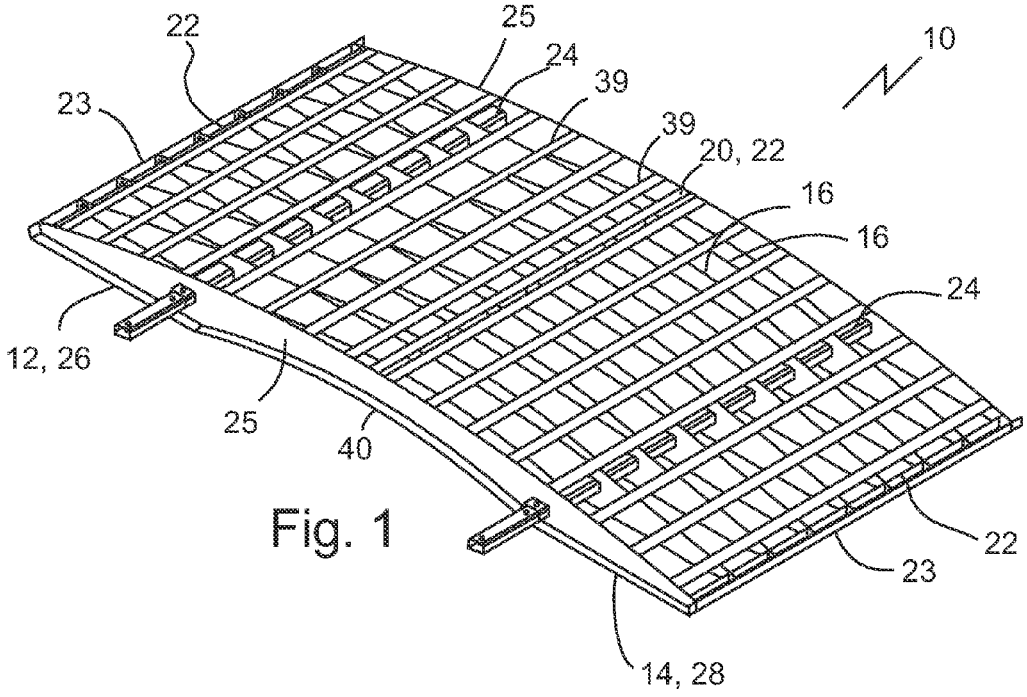
FIG. 1 is a perspective view of the top of a pipeline crossing bridge with the apron removed.

Immaterial modifications may be made to the embodiments described here without departing from what is covered by the claims.

Pipelines are used across North America and the rest of the world to transport fluids such as petroleum products a distance from source to sink. Pipelines may be buried underneath, laid upon, or supported in a raised position above terrain. Because of the distances travelled by such pipelines, and other factors, it is often necessary for a road or passage to cross a pipeline. For raised pipelines and pipelines lying on the ground, it may be possible to provide a road overtop of the pipeline, for example using a bridge. In some cases, the road may be provided underneath the pipeline.

For buried pipelines, the crossing passes over the pipeline, for example directly or indirectly above fill material above the pipeline. Regulations may determine the minimum depth of fill required between the pipeline and the road in some cases. Regardless, vibration and compression from multiple crossings over time may lead to damage and eventual failure of the buried pipeline. In some cases a thick layer of clay or other dampening material may be provided above the fill material. However, such layers may be expensive to construct, and may still transfer vibrational and compressional energy to the pipeline, ultimately leading to pipeline damage.

Referring to FIGS. 1-6, a pipeline crossing bridge 10 is provided comprising first and second ground contacting pads 12 and 14, respectively (FIGS. 1, 2, 4, and 6), plural ribs 16 (FIGS. 1 and 3), and an upper crossing surface, such as an apron 18 (FIGS. 2, 4, 5, and 6). The first and second ground contacting pads 12, 14, are spaced apart from one another, and may be planar in shape to transfer load across a sufficiently wide ground area.

The plural ribs 16 have lateral stabilizing elements 20, such as one or more truss alignment bars 22 (FIGS. 1 and 3), between adjacent ribs 16 of the plural ribs 16. Elements 20 may extend between two or more of the plural ribs 16. In the example shown, the truss alignment bar 22 spans all of the plural ribs 16. Other components such as support tubes 24 may form lateral stabilizing elements 20, for example by passing laterally through the entire set of plural ribs 16 for strength. Lateral stabilizing elements 20 prevent plural ribs 16 from folding under loading during use. Ribs 16 and stabilizing elements 20 may collectively form a skeleton or frame 21, which may include other elements such as end plates 23 and side plates 25, which may have the same shape as ribs 16.

Figure 6:
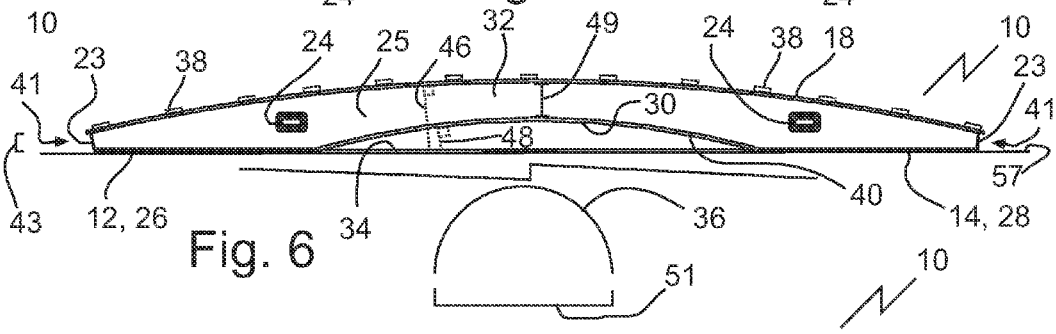
FIG. 6 is a side elevation view of the pipeline crossing bridge of FIG. 1.

Each rib 16 of the plural ribs 16 is supported on both the first and second ground contacting pads 12, 14. Ribs 16 may be spaced a suitable distance apart, for example one foot or less apart. Ribs 16 may run parallel to one another in the longitudinal direction as shown. In the example shown, pads 12 and 14, which each may include one or more feet (not shown), are provided by support plates 26, 28, respectively, connected to the plural longitudinal ribs 16. Pads 12 and 14 may be positioned on a foundation (not shown) or on a ground surface 57 (FIG. 6). The ribs 16 collectively form an arch 30 extending between the first and second ground contacting pads 12, 14. The bridge 10 may have an arcuate middle portion 32 as shown that in use is raised above ground 34 that is desired to be crossed, such as ground 34 that is directly above a buried pipeline 36 (FIG. 6).

The throat or arch 30, which may be segmental as shown, may be wider than a diameter 51 of the pipeline 36 as shown (FIG. 6). A segmental arch may be used over a semi-circular arch to reduce the maximum vertical height of bridge 10 while increasing the arch 30 span distance between the pads 12, 14. By positioning bridge 10 over pipeline 36 so that the arcuate middle portion 32 is spaced above the ground 34, bridge loading is transferred away from ground 34 directly above the pipeline 36, thus reducing or eliminating damage to pipeline 36 that may otherwise occur over multiple crossings. In addition, arcuate middle portion 32 provides a convenient location for bridge 10 to be gripped and lifted during loading and unloading with suitable loading equipment such as a backhoe, crane, loader, or excavator.

The upper crossing surface or apron 18 (FIGS. 2, 3, 4, 5, and 6) may be positioned at least partially over the ribs 16 and is supported directly or indirectly by the plural ribs 16. Lateral supports such as cross beams 39 (FIGS. 1 and 3) may be positioned between ribs 16 and apron 18. The combination of ribs 16 with lateral stabilizer elements 20 may be easier to manufacture and more resistant to folding under loading than the longitudinal corrugations (not shown) used in existing bridges. The apron 18 may be adapted to increase traction, for example by use of one or more traction bars 38. Other suitable methods may be used to increase traction, for example using a textured or divoted upper surface (not shown).

A lower apron 40 (FIGS. 1, 2, 4, and 6) may be secured at least partially under the plural ribs 16, for example under the ribs 16, over the arch 30 and between the ground contacting pads 12, 14. In some cases, pipeline crossing bridge 10 is entirely enclosed to prevent unwanted incursion into the bridge interior by dirt, contaminants, animals, plants, or other undesired elements. In other cases, bridge 10 may have plural holes 42 (FIGS. 2 and 5) in apron 18 to allow air pressure equalization during loading, reduce bridge weight, allow evaporation of standing water or fluids within bridge 10, and increase traction on apron 18.

In the oil and gas industry, it is sometimes necessary to provide ground cover mats with sufficient strength to support heavy equipment and transport trucks over wet or disturbed ground. Oil field exploration and drilling operations are often undertaken in geographic areas that are, in their natural state, inaccessible to vehicles and equipment necessary for such exploration. These areas include swamps, marshlands, riverbeds, snow covered regions, and areas with soft or sandy soil. In order to explore for oil in such areas, it is necessary to locate heavy drilling rigs, vehicles and other equipment for some period of time on or adjacent to the location where the well is to be drilled. In order to transport this heavy equipment to the site and to support the equipment at the site, the industry has used for many years temporary roads leading to and from the site and flooring systems or pads at the particular site.

Existing flooring systems may involve a series of prefabricated mats. Mats are currently used for temporary road and access track in many other industries as well. Such mats may be generally used as alternatives to asphalt and concrete road paving, or for temporary storage pads for supplies and equipment. In contrast with traditional surfaces made with asphalt, gravel, or concrete, temporary road mats may cause less of a negative environmental impact, may be quicker and easier to set up, and may be easier to obtain required building permits for.

Referring to FIG. 6, bridge 10 may form part of a ground cover mat system (not shown). For example, bridge 10 may interlock longitudinally with one or more ground cover mats (not shown) to form a temporary roadway for rig equipment. In other embodiments, bridge 10 may be used as a standalone unit. Apron 18 may have a smooth and continuous tapered or arcuate shape as shown across the entire longitudinal length of the apron 18, terminating at opposed ramp ends 41. Ramp ends 41 may be sloped toward the ground or may terminate at an end height 43 sufficiently low to allow vehicular traffic to drive onto the apron 18 from the adjacent ground 57 or from an adjacent mat (not shown). In one example, the end height 43 may be five inches or less off the ground, thus lower than or equal to a standard curb height. The apron 18 may be designed to reduce or minimize disturbance to vehicular traffic over mat 10, for example, by ensuring that apron 18 has a maximum slope of 20 degrees or less relative to ground level.

Bridge 10 may be formed as an arcuate mat as shown. A mat is understood to have a relatively constant vertical thickness, for example within 0-10 inches deviation from a mean vertical thickness, along the longitudinal length of the mat. Mat form allows bridge 10 to be effectively vertically stacked for example on a trailer bed, rail bed or other suitable cargo bed. After unloading, bridge 10 may be positioned directly upon ground surface 57 without burying bridge 10 fully or partially with fill (FIG. 6). In some cases a radius of curvature 46 of the apron 18 is larger than a radius of curvature 48 of the arch 30, for example so that a minimum vertical arch height 49 is present at the longitudinal center of the arch 30 as shown. The apron 18 may thus have a shallower slope than the arch 30, thus reducing disturbance to traffic passing over bridge 10 while ensuring sufficient vertical spacing from ground 34 under arch 30. If the arch 30 or apron 18 shapes have a degree of eccentricity, then the average radii of curvature should be used.

Figure 2:
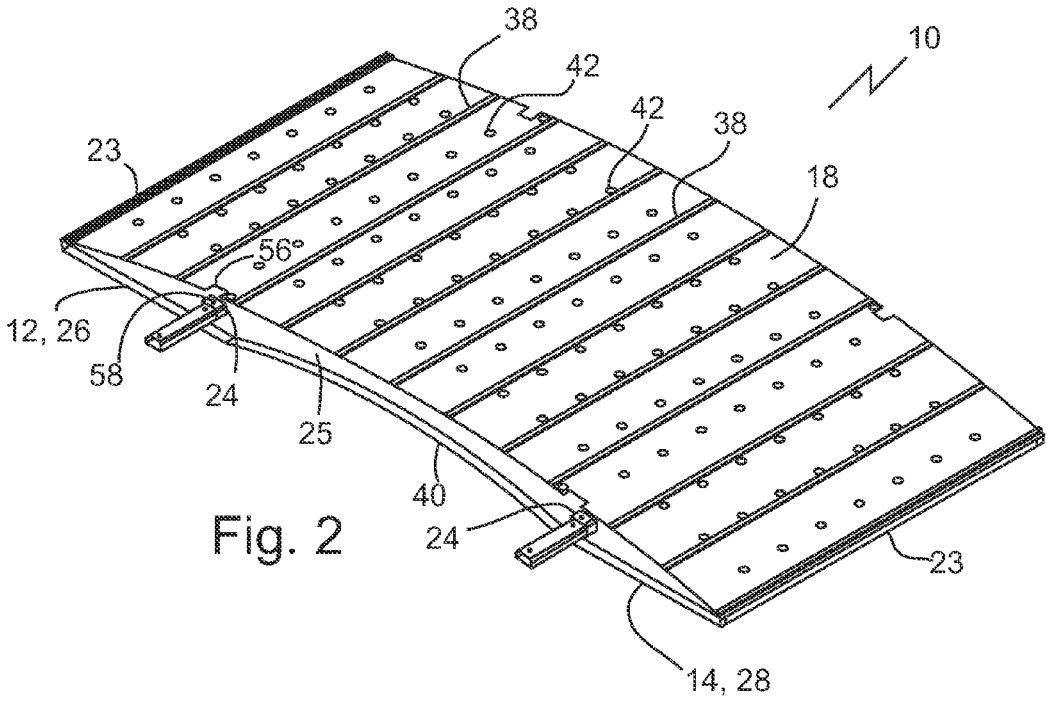
FIG. 2 is a perspective view of the top of the pipeline crossing bridge of FIG. 1 with the apron in place.
Figure 3:
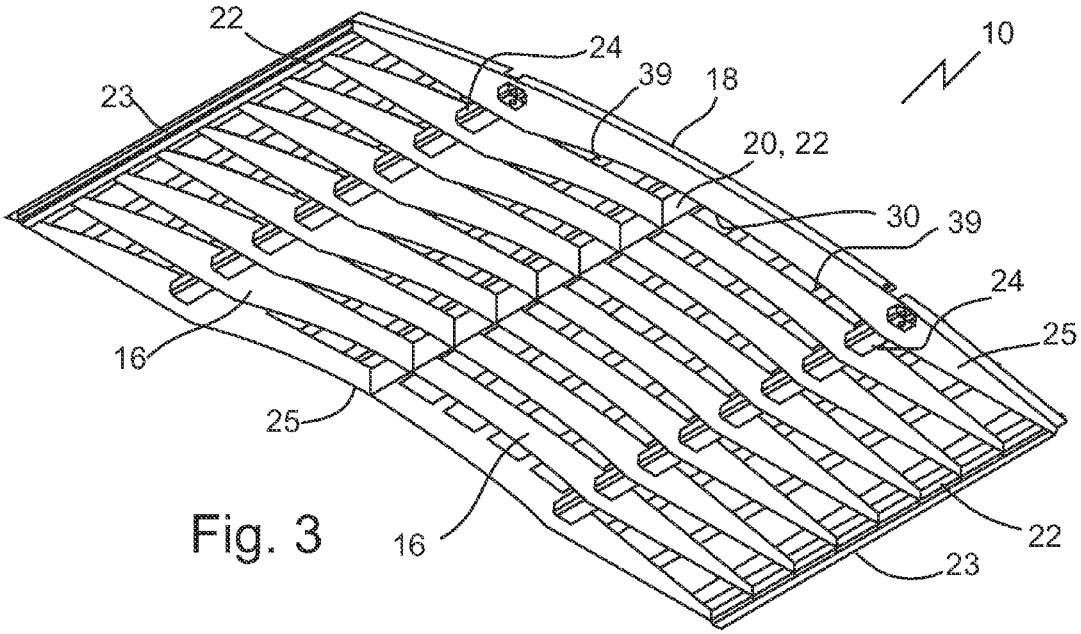
FIG. 3 is a perspective view of the bottom of the pipeline crossing bridge of FIG. 1 with the lower apron removed.
Figure 4:
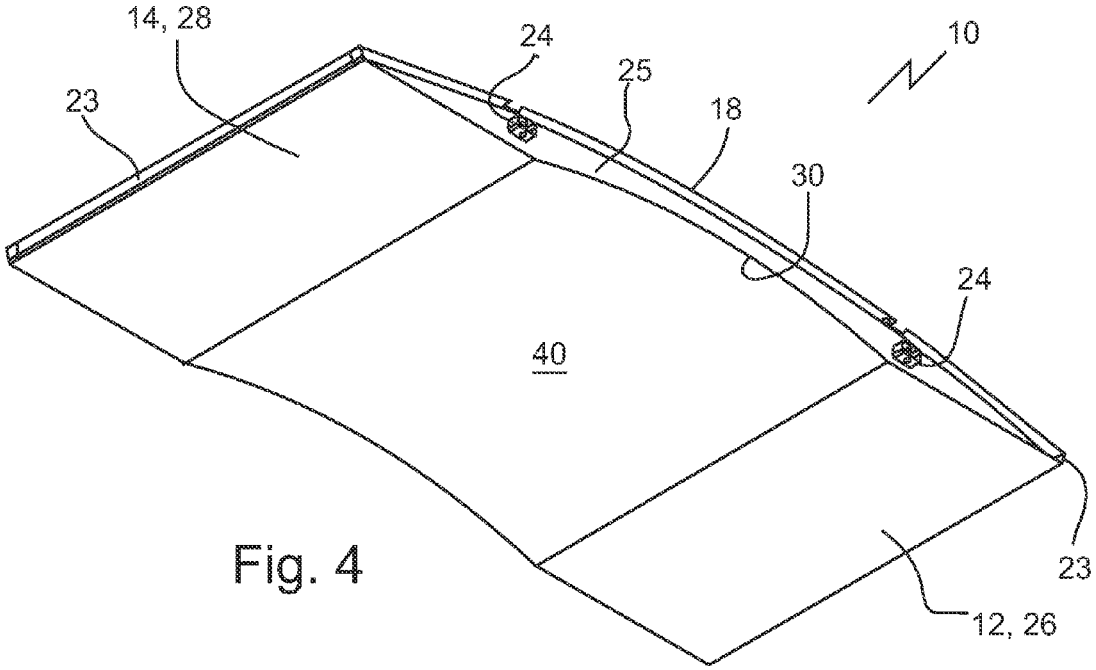
FIG. 4 is a perspective view of the bottom of the pipeline crossing bridge of FIG. 1 with the lower apron in place.
Figure 5:
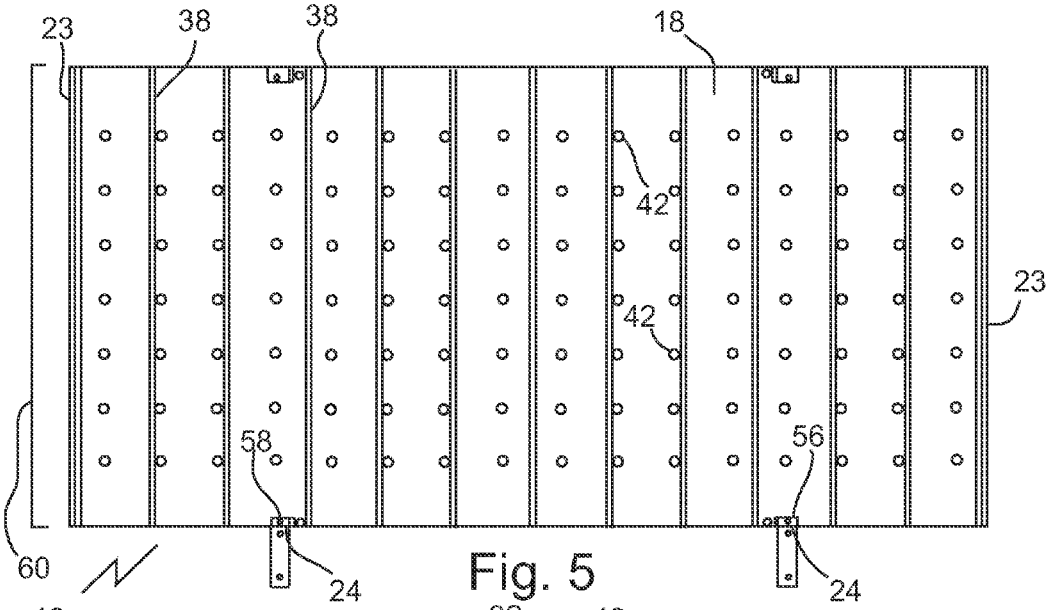
FIG. 5 is a top plan view of the pipeline crossing bridge of FIG. 1 in position over a buried pipeline.
Figure 7:
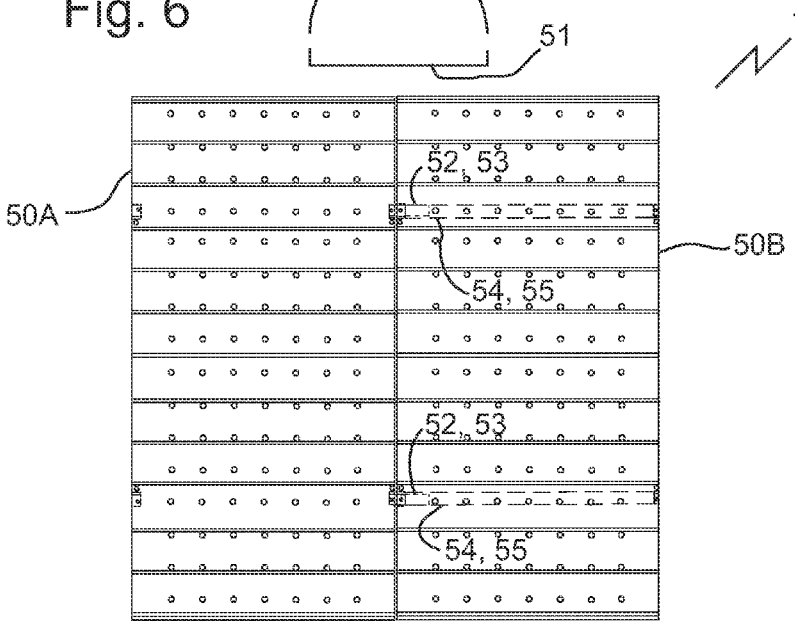
FIG. 7 is a top plan view illustrating the lateral interconnection of adjacent mats, with the portion of the male member that is inserted within the female member of the adjacent mat shown in dashed lines. The support tubes that form the female member within the adjacent mat are also shown in dashed lines.

Referring to FIG. 7, the bridge 10 may be separable into two or more longitudinal portions 50A, 50B that interlock together with lateral alignment elements 52, 54 in the longitudinal portions 50A, 50B, respectively. In the example shown, alignment elements 52 are male members 53 that extend laterally into female members 55 such as support tubes 24. Referring to FIGS. 2 and 5, cutouts 56 may be provided in apron 18 to allow a user vertical access to holes 58 for securing male members 53 and thus portions 50A, 50B together in place with screws or bolts (not shown) for example.

By providing bridge 10 in two or more separable longitudinal portions 50A and 50B, a bridge of a suitable width wider than a single longitudinal portion 50 may be conveniently assembled on site but transported to the site in separate, narrower, pieces. In addition, in some embodiments longitudinal portions 50A, 50B, or bridge 10 may be provided with a lateral width 60 (FIG. 5) sufficiently narrow, for example twelve feet six inches or less, so as to allow horizontal transportation, for example on a truck bed (not shown), without the use of a pilot vehicle, thus saving on transportation costs. Widths of eight feet or less may also be used.

Although described above for use in spanning buried pipelines, in some cases bridge 10 may be used to span a gap defined by a river, gulley, or other uneven terrain to provide safe travel by heavy duty equipment or vehicles over the gap. Other natural or manmade formations such as above ground pipelines or partially buried drainage culverts may be spanned by bridge 10. In some cases, the upper crossing surface may be planar, for example horizontally planar.

Bridge 10 may be rated to support loads of 60,000 pounds or more. In some embodiments bridge 10 is adapted to facilitate the passage of heavy duty equipment and vehicles over wet or disturbed ground. All dimensions are exemplary and other dimensions may be used, for example dimensions greater or smaller than the exemplary dimensional ranges provided. In addition, the use of directional language such as vertical and horizontal in this document illustrate directions that are relative to a ground surface 57 (FIG. 6) that bridge 10 is placed upon. Although not illustrated in the Figures, supports that are angled relative to the longitudinal, vertical, and lateral directions may be used in the construction of bridge 10.

I claim:

1. A combination of a buried pipeline and a pipeline crossing bridge, the pipeline crossing bridge comprising:

a first ground contacting pad and a second ground contacting pad spaced apart from one another;

plural ribs with lateral stabilizing elements between adjacent ribs of the plural ribs, in which each rib of the plural ribs is supported on the first ground contacting pad and the second ground contacting pad and the ribs collectively form a raised arch extending between the first ground contacting pad and the second ground contacting pad, in which the raised arch is a segmental arch, and the plural ribs comprise three or more ribs;

an upper crossing surface supported by the plural ribs, the upper crossing surface having a first curvature defined in a longitudinal direction between the first ground contacting pad and the second ground contacting pad, the first curvature having a first longitudinal radius of curvature, the raised arch having a second curvature defined in the longitudinal direction and having a second longitudinal radius of curvature, the first longitudinal radius of curvature being parallel to and larger than the second longitudinal radius of curvature;

a plurality of lateral supports positioned between the plural ribs and the upper crossing surface;

a lower apron secured under the ribs, over the raised arch and between the first ground contacting pad and the second ground contacting pad, in which the lower apron and upper crossing surface define a hollow interior containing the plural ribs and lateral stabilizing elements; and one or more lateral alignment elements on each side of the pipeline crossing bridge for interlocking with one or more lateral alignment elements of one or more adjacent pipeline crossing bridges;

in which the pipeline crossing bridge has a lateral width of twelve feet six inches or less to allow horizontal transportation of the pipeline crossing bridge without the use of a pilot vehicle;

in which the pipeline crossing bridge is positioned over the buried pipeline and formed as an arcuate mat, and in which the buried pipeline has a diameter, and the first ground contacting pad and the second ground contacting pad are spaced apart wider than the diameter of the buried pipeline.

* * * * *